United States Patent [19]

Bessman et al.

[11] 4,344,743

[45] Aug. 17, 1982

[54] PIEZOELECTRIC DRIVEN DIAPHRAGM MICRO-PUMP

[76] Inventors: Samuel P. Bessman, 7404 Woodrow Wilson Dr., Los Angeles, Calif. 90046; Lyell J. Thomas, Jr., 1900 Pelican Ave., San Pedro, Calif. 90732

[21] Appl. No.: 100,094

[22] Filed: Dec. 4, 1979

[51] Int. Cl.[3] ..... F04B 17/00

[52] U.S. Cl. ..... 417/317; 417/322; 417/389; 417/478; 417/505

[58] Field of Search ..... 417/317, 322, 478, 505, 417/389; 128/1 D

[56] References Cited

U.S. PATENT DOCUMENTS

| | | | |
|---|---|---|---|
| 1,764,712 | 6/1930 | Brackett et al. | 417/439 X |
| 3,029,743 | 4/1962 | Johns | 417/322 |
| 3,551,076 | 12/1970 | Wilson | 417/478 X |
| 3,819,305 | 6/1974 | Klochemann et al. | 417/505 X |
| 3,857,382 | 12/1974 | Williams et al. | 417/322 X |
| 3,963,380 | 6/1976 | Thomas et al. | 417/322 |
| 4,150,922 | 4/1979 | Cuenoud et al. | 417/317 X |

FOREIGN PATENT DOCUMENTS

| | | | |
|---|---|---|---|
| 478125 | 10/1975 | U.S.S.R. | 417/322 |

*Primary Examiner*—Carlton R. Croyle
*Assistant Examiner*—Edward Look
*Attorney, Agent, or Firm*—Fidelman, Wolffe & Waldron

[57] ABSTRACT

A piezoelectric driven variable volume having a chamber pump with a flexible tube and a non-compressible fluid therein. Solenoid operated valves are associated with the inlet and outlet of the flexible tube. A control circuit sequences the valves and the piezoelectric drive to pump small volumes of liquid through the flexible tube by a diaphragm-type action.

2 Claims, 7 Drawing Figures

PIEZOELECTRIC DRIVEN DIAPHRAGM MICRO-PUMP

BACKGROUND OF THE INVENTION

1. Field of the Invention

The present invention relates generally to pumps and more specifically to a pump for implantation into the human body.

2. Description of the Prior Art

In the field of fluid delivery systems for use in the human body, the present devices are either not wholly implantable or the devices are not directly controllable or capable of preventing blow-through caused by pressure applied to the inlet of the pump. The latter feature is necessary to insure that potentially dangerous overdoses of drugs or hormones are not inadvertently forced into the host by sudden pressure on the reservoir, as might be caused by a blow.

Prior U.S. Pat. No. 3,963,380, to which reference is made, describes the concepts and advantages of a piezoelectric disk bender for powering micro-pumps. Briefly, that pump and the diaphragm pump of this invention employ a piezoelectric variable volume chamber and a solenoid controlled valve arrangement operated in sequence to pump small volumes of liquid. The sequence is produced by developing a phase difference between the control of the piezoelectrical chamber and the solenoid valve arrangement.

According to the practice of this invention, it has been found possible to convert the micro-pump described by U.S. Pat. No. 3,963,380 into a diaphragm pump and to obtain superior results thereby.

One difficulty discovered in the specific embodiment described by U.S. Pat. No. 3,963,380 is that the pump turned out to be sensitive to the presence of any gas bubbles in the medium being pumped. The bubbles could accumulate in the pump, and, on occasion, the pump might become gas bound.

In addition, the micro-pump of the earlier invention requires, relatively speaking, a large quantity of pumped medium inside the pump system. Priming the pump requires considerable care.

SUMMARY OF THE INVENTION

In the pump structure herein contemplated the variable volume chamber, on which the disk bender of benders operate, is filled and sealed with an essentially non-compressible liquid. A one-time filling, as is now employed, permits considerable care to be taken so that the noncompressible liquid is bubble-free and even deaerated.

Inside the sealed chamber is a flexible tube through which flows the fluid being pumped. Presence of this flexible tube, in effect, converts the variable volume chamber into a diaphragm or bladder pump. The pressure changes generated by the piezoelectric benders are transmitted to the flexible tube, via the non-compressible liquid, expanding and constricting the tube to pump the fluid therethrough.

It has been found possible to employ the concepts and structures of the piezoelectric pump with a bladder arrangement while retaining the controlled volumes and other capabilities of a piezoelectric drive.

OBJECTS OF THE INVENTION

The principal objective of the present invention is to provide a piezoelectric powered bladder pump that is self priming and even is capable of pumping a gas.

Other objects, advantages and novel feature of the present invention will become apparent from the following detailed description of the invention when considered in conjunction with the accompanying drawings.

DESCRIPTION OF THE PREFERRED EMBODIMENTS

Figure 1:
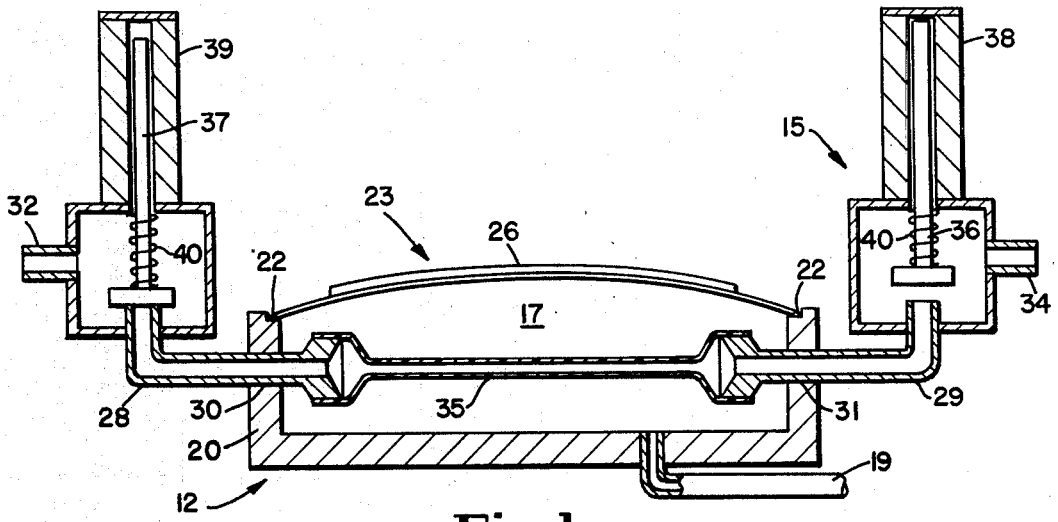
FIG. 1 is a cross-section of the pump of the present invention in an intake stroke.

FIG. 1 illustrates a preferred embodiment of the pump with the variable volume chamber 12 and solenoid controlled valves 14 and 15. The variable volume chamber 12 includes a cylindrical section 20 having an internal shoulder 22. Resting on the shoulder 22 (and forming the remainder of the chamber) is a disk bender 23 which changes its shape in response to an electrical signal. Cylindrical element 20 may be made of plastic or metal, for example Lexan; and the disk bender may be a commercially available unit, for example, disk bender type G-1500, available from Gulton Industries, Fullerton, Ca. The disk bender 23 may be secured to the cylindrical element 20 by contact cement (for example, Eastman 910), by soldering, or by clamping. The disk bender consists of a thin wafer 26 (0.009 inch thick and 0.980 inch in diameter) of piezoelectrical material (lead zirconate-titanate piezoceramic) bonded with epoxy cement to a slightly larger disk 24 of brass shim stock (0.10 inch thick and 1.375 inch in diameter). The outer surface of the wafer has a thin layer of silver deposited thereon. Electrical connections are made by soldering to this layer of silver and to the brass disk.

When voltage is applied between the silver film and the brass disk, the resulting electrical field that is set up within the crystal causes it to expand or shrink in diameter, depending upon the direction of the applied voltage. However, since the circumference of the crystal cannot increase because of the bonding to the brass disk 24, the resulting motion is that of bulging in the center to form a spherical surface. The magnitude of the change is proportional to the applied voltage.

According to the practice of this invention the variable volume chamber 12 is a sealed-off system, filled with a noncompressible liquid 17, e.g., deaerated bubblefree water or silicon oil. Chamber 12 is filled through filling tube 19; then tube 19 is sealed. The pressures generated inside liquid 17 by piezoelectric disk bender 23 expand and constrict the diameter of a flexible inner sleeve 35 present in chamber 12.

Variable volume chamber 12 is connected to solenoid valve 14 by a conduit 28 received within an aperture 30 in wall 20. A like conduit 29 received within an aperture 31 in wall 20 connects chamber 12 to solenoid valve 15. Flexible inner sleeve 35, e.g., a soft teflon ⅛" tube 0.001" wall thickness, joins conduits 28 and 29.

Valve 15 has an inlet 34 for entry of fluid being pumped through the system, while valve 14 has an outlet 32. The fluid communication from inlet 34 to outlet 32 is by way of flexible inner sleeve 35 through chamber 12. This fluid communication is controlled at valve 15 by armature 36 of solenoid 38 and at valve 14 by armature 37 of solenoid 39. Either or both of armatures 36, 37 is held in a closed position by a spring 40 when the solenoids 38, 39 are deactivated. The inlet 34 is connected to a reservoir containing the fluid to be dispensed and outlet 32 is connected to the portion of the body that receives the fluid.

Illustrated in FIG. 1 is the suction phase of the pump, when the volume in chamber 12 is expanded and valve 15 is open. The absence of liquid pressure on sleeve 35 allows fluid flow into sleeve 35. When the circuit shifts (to close valve 15, to open valve 14, and to actuate disk bender 23 in the other direction), the pressure increase in liquid 17 is applied against sleeve 35, compressing it and pumping the fluid therein out through conduit 28 and the then open valve 14 to outlet 32.

The advantages of a piezoelectric micro-pump are retained in the bladder pump of this invention. The forces doing useful work are developed electrostatically within a crystal. Frictional wear is essentially eliminated by absence of bearings and sliding parts. The only wear surface is flexible sleeve 35 and, for that member, plastics technology has long since made available resiliant materials capable of undergoing many millions of flex cycles.

Advantageously, the response rate of support disk 24 to the forces generated by piezoelectric disk bender 23 is reasonably close to the flexure response rate of inner sleeve 35 to pressure changes, both responding adequately to pulses lasting just a few milliseconds, e.g., about 10 milliseconds. As a result, the bladder pump of this invention has the operating characteristics of the piezoelectric actuated micro-pump described in U.S. Pat. No. 3,963,380.

Figure 2:
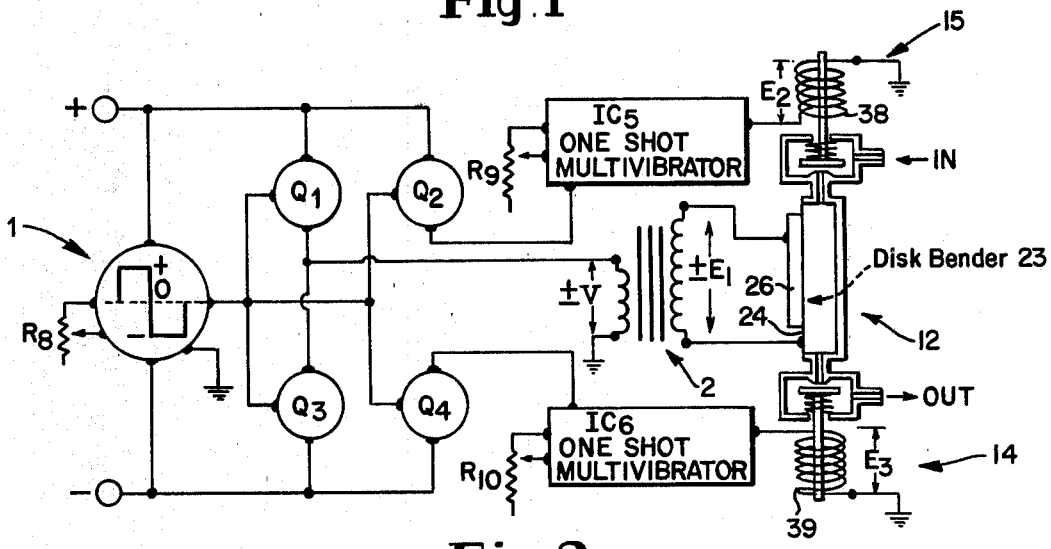
FIG. 2 is a generalized partial schematic of the control circuit for the pump.
Figure 3:
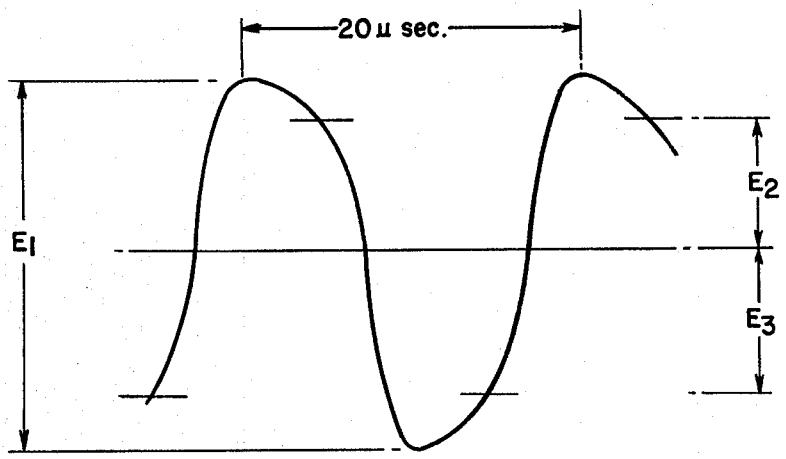
FIG. 3 is a tracing from an oscilloscope showing the voltage across the disc bender, as well as the voltages across the inlet and outlet valves, $E_1$ having a different scale from $E_2$ and $E_3$.
Figure 7:
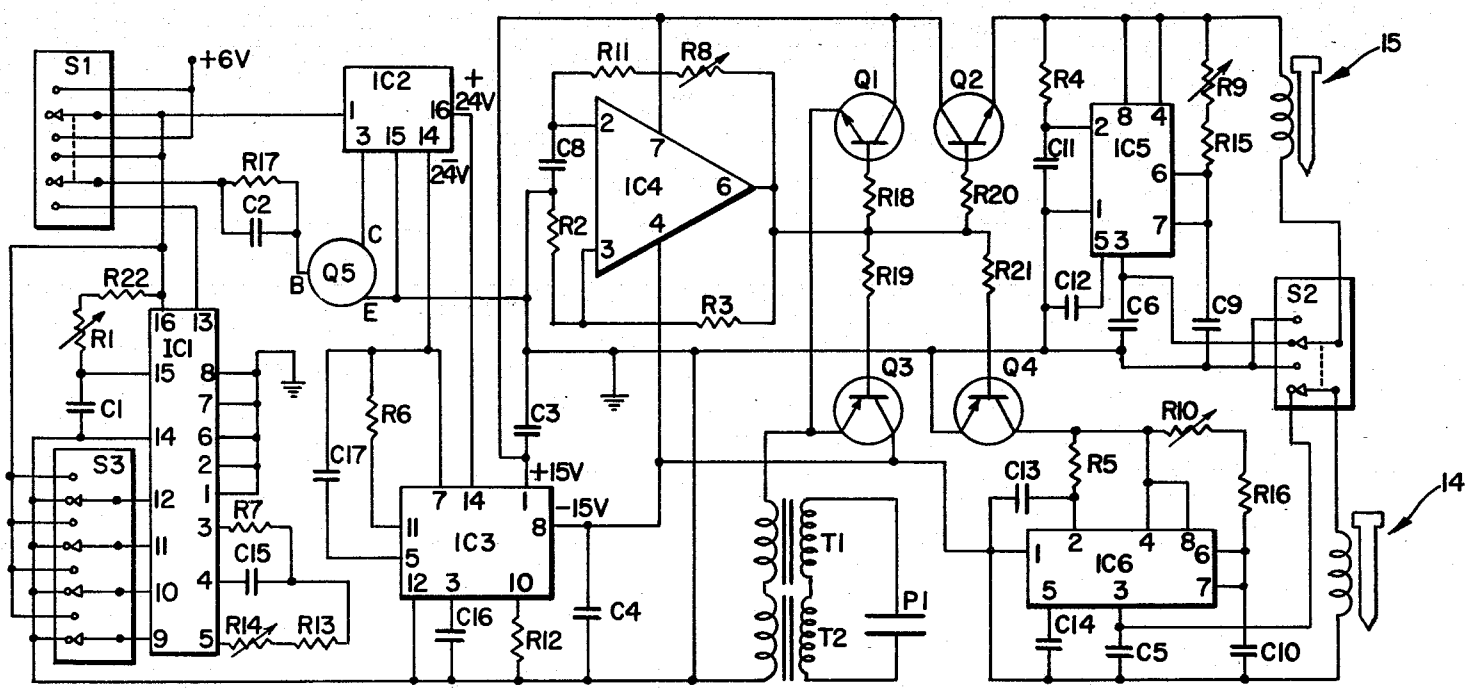
FIG. 7 is a schematic of a preferred embodiment of the control circuitry for the pump.

The major elements of the pump operating circuit are shown in FIG. 2, while FIG. 7 illustrates the details of a preferred embodiment of pump operating circuit.

Referring to FIG. 2, a rectangular wave oscillator 1, whose frequency can be controlled from about 40–70 Hz by variable resistor $R_8$, alternately turns on the respective pairs of transistors $Q_1$, $Q_2$ and $Q_3$, $Q_4$. Thus, $Q_1$ and $Q_3$ alternately conduct from V+ and V− to ground, alternately causing opposite energizing current paths through the primary of transformer 2. Likewise, $Q_2$ and $Q_4$ alternately actuate respective one-shot multivibrators $IC_5$ and $IC_6$, to cause current conduction through alternate coils 38 and 39 of solenoid valves 14 and 15. The periods of time of current conduction (e.g., 2–10 msec) through coils 38 and 39 are controllable, respectively, by variable resistors $R_9$ and $R_{10}$. The leads of the secondary of transformer 2 are respectively connected to the piezoelectric crystals 26 and the brass disc 24. These connections to disc bender 23 are such that it bends toward or away from flexible inner sleeve 35 in response to a positive or negative voltage induced in the secondary. The secondary of transformer 2 provides a voltage high enough for efficient deformation of the piezoelectric wafer 26 in cooperation with the actuation of solenoid valves 14 and 15, to thus provide proper sequencing of the pulses of fluid medium through variable volume chamber 12 via flexible tube 35. The signal generator 1 may provide continuous periodic pulses to operate the pump continuously or may provide a fixed number of pulses for intermittent operation of the pump.

A preferred embodiment of the control system is shown schematically in FIG. 7 in which notation corresponding to FIG. 2 is used, except that rectangular wave generator 1 is replaced by $IC_4$ and the disc bender 23 is represented by P. The rectangular wave generator $IC_4$ may be a conventional 741 operational amplifier controllable in frequency from 40–70 Hz by variable resistor $R_8$. However, any other type of device may be utilized which provides the rectangular wave voltage pulse with sufficient power and which can be regulated as to frequency and pulse duration in the frequency range of 20–70 Hz. $IC_1$ is a programmable timer for this circuit and contains a one-shot multivibrator which, when activated, causes transistor $Q_5$ to conduct for a few tenths of a second to turn on DC—DC converter $IC_2$.

The one-shot multivibrator of timer $IC_1$ is activated at timed intervals determined by its digital (BCD) controls, which are set by means of $S_3$. Thus, the interval between pulse trains is determined. The transformer 2 may be a pair of miniature audio input types such as Allied Electronics, Archer catalogue No. 273–1376 connected in series, shown in FIG. 7 as $T_1$ and $T_2$, with the disc bender $P_1$ connected across the high impedance windings. $IC_3$ is a voltage regulator for supplying regulated voltages V+ and V− . The input power required for this embodiment is approximately 2.3–2.5 watts.

It is to be noted that none of the above described circuitry is uniquely required and that a variety of electronic configurations could be employed to the same end.

Figure 4:
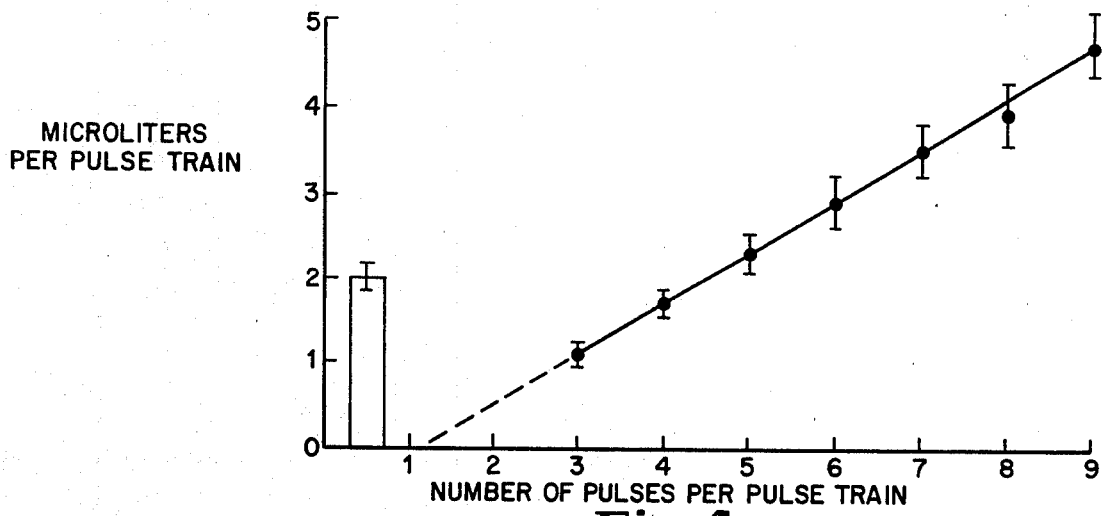
FIG. 4 is a plot of data from a working pump, showing output volume of the pump as a linear function of the number of pulses per pulse train.
Figure 5:
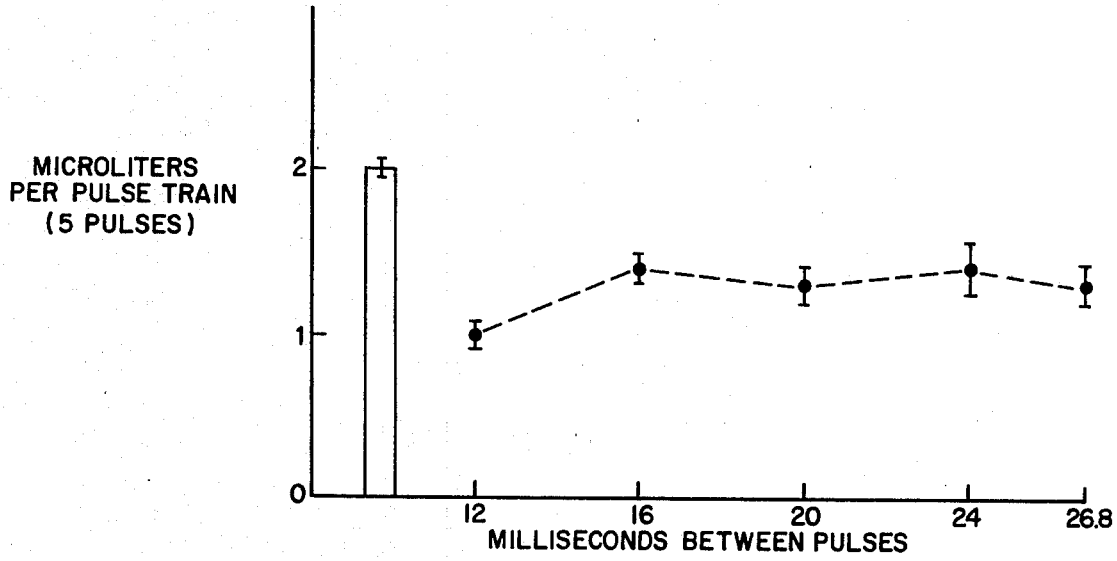
FIG. 5 is a plot of data from a working pump, showing output volume as a function of the time interval (milliseconds) between pulses.
Figure 6:
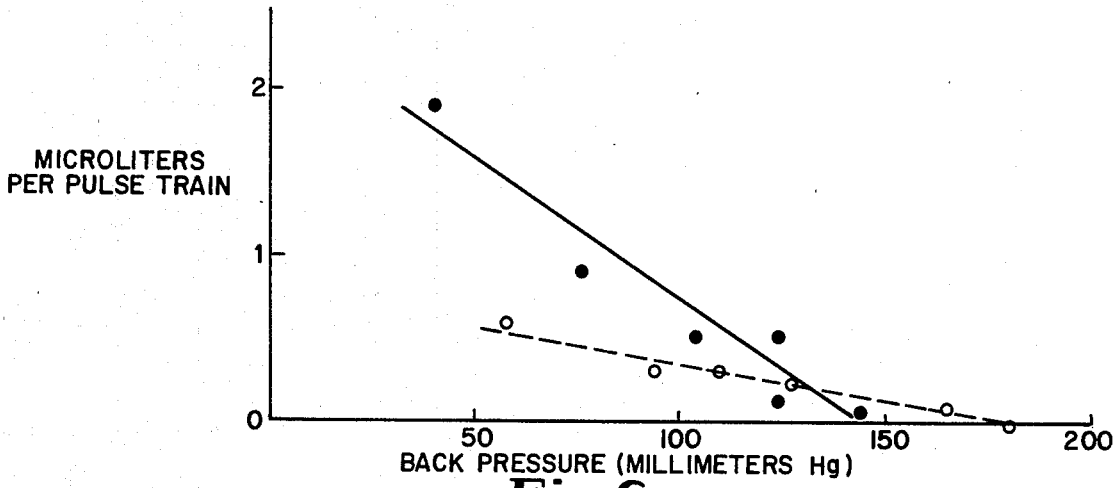
FIG. 6 is a plot of data from a working pump, showing output volume as a function of back pressure (in mm $H_g$) developed against a resistance to outflow.

The volume output of the pump, as shown in FIG. 4, is a linear function of the number of pulses in a pulse train. In practice, both the number of pulses in a pulse train and the frequency with which the pulse train occurs have ben used to regulate the output of the pump. This dual mode of control provides a theoretically infinite range of outputs. Superimposed on the above, additional "fine-tuning" of output can be achieved by adjusting the frequency of the oscillator (the interval between pulses in a pulse train—see FIG. 5) as well as the duration of valve opening (and its relationship to back pressure, as shown in FIG. 6). As shown in FIG. 5, the output of the pump (for a given number of pulses in a pulse train) is essentially constant when the time interval between pulses ranges from 16 to 24 msec, corresponding to a frequency range of about 42 to 62 Hz. By adjusting the duration of valve opening, the pump output per pulse of a pulse train and the back pressure which will halt the flow are altered. As shown in FIG. 6 (closed circles), the pump and valve system can be optimized for maximum volume delivered in situations where variation in back-pressure is small by setting $R_9$ and $R_{10}$ (FIGS. 2 and 7) so that the valves stay open for a relatively long period of time. On the other hand, the pump can also be optimized to increase the constancy and reproducibility of flow (open circles) if significant fluctuation of back pressure should occur by reducing the duration of valve opening. This latter is an important safety feature as one can adjust pump output to be minimally sensitive to back pressure. This ability to control valve action independent of pump frequency (as shown in FIG. 5) represents a considerable improvement over the single valve version. However, as was the case with the single valve version, the most important safety feature is the arrangement of valves so as to prevent fluid from passing through the pump with power off and to cause closure of valves in the event of an externally applied pressure.

Although one preferred embodiment has been described in detail using specific commercially available components, these are but examples of piezoelectric elements, electrically operated valves, signal generators and phase shifting circuits.

Configuring the piezoelectric pump as a bladder pump system provides several distinct advantages.

The pump is self priming, and even is capable of pumping air; the exemplary embodiment herein described was capable of pumping air against 60 mm of mercury. It could pump liquids against 200 mm of mercury. The improvement in pumping pressure is believed to be due, in part, to the sharp reduction in volume of pumped fluid inside the pump system. The pumped volume inside chamber 12 has been reduced to the quantity present inside flexible tube 35. In part, the improvement may be due to the self clearing gas pumping capability of the flexible tube. In part, the improvement may be due to the presence inside chamber 12 of a gas-free non-changing charge, e.g., deaerated water or silicon oil.

It is difficult to fill chamber 12 without introducing bubbles or permitting bubbles to remain behind. In addition, expansion of chamber 12 through the piezoelectric effect can cause cavitation at the liquid interface with wall 24. In any event, conversion of chamber 12 into a closed region that need be filled only once allows for a one time, careful filling with (deareated) liquid. In consequence, the pump of this invention generates a pumping pressure about 50% higher than that acheived in the pump described by U.S. Pat. No. 3,963,380.

The spirit and scope of this invention are to be limited only by the terms of the appended claims.

What is claimed is:

1. A pump having an inlet and an outlet and comprising:

a sealed variable volume chamber;

a flexible tube inside said variable volume chamber and connected to said inlet and outlet;

a piezoelectric means forming a wall of said chamber for varying the volume of said chamber;

an essentially non-compressible liquid within said chamber to transmit forces created inside said chamber to said flexible tube during the volume variation of said chamber;

solenoid valve means for controlling the flow of fluid through said inlet and outlet; and control means connected to said piezoelectric means and said solenoid valve means for electrically activating said piezoelectric means and said solenoid valve means in a desired sequence to pass fluid from said inlet to said flexible tube and to pump fluid from said flexible tube to said outlet, said control means comprising an oscillator means for providing an electric signal output of a selectively fixed frequency, adjustable valve opening duration means for controlling the time duration of activation of said solenoid valve means, a step-up transformer having the secondary connected across said piezoelectric means and the primary adapted to alternately conduct current in opposite directions according to said oscillator output signal, first switch means activated by said oscillator output signal for providing current in alternate, opposite directions to said primary, and second switch means for activating said valve opening duration means according to said oscillator frequency;

whereby the volume of fluid pumped by and through said flexible tube is a function of the selectively fixed oscillator output frequency and the adjustable time duration of activation of said solenoid valve means.

2. A pump having an inlet and an outlet and comprising:

a sealed variable volume chamber;

a flexible tube inside said variable volume chamber and connected to said inlet and outlet;

a piezoelectric means forming a wall of said chamber for varying the volume of said chamber;

an essentially non-compressible liquid within said chamber to transmit forces created inside said chamber to said flexible tube during the volume variation of said chamber;

solenoid valve means for controlling the flow of fluid through said inlet and outlet; and control means connected to said piezoelectric means and said solenoid valve means for electrically activating said piezoelectric means and said solenoid valve means in a desired sequence to pass fluid from said inlet to said flexible tube and to pump fluid from said flexible tube to said outlet, said control means comprising an oscillator means for providing an electric signal output of a selected frequency, adjustable valve opening duration means for controlling the time duration of activation of at least one solenoid valve, a step-up transformer having the secondary connected across a piezoelectric means and the primary adapted to alternately conduct current in opposite directions according to said oscillator output signal, first switch means for providing current in alternate, opposite directions to said primary and activated by said oscillator output signal, and second switch means for activating said valve opening duration means according to said oscillator frequency;

whereby the volume of fluid pumped by and through said flexible tube is a function of the selected oscillator output frequency and the adjustable time duration of activation of said solenoid valve means.

* * * * *